United States Patent [19]

Zurcher

BEST AVAILABLE COPY

[11] 3,996,735

[45] Dec. 14, 1976

[54] ELECTRONIC WATCH CONSTRUCTION

[75] Inventor: Rudolf F. Zurcher, Newport Beach, Calif.

[73] Assignee: Hughes Aircraft Company, Culver City, Calif.

[22] Filed: Sept. 2, 1975

[21] Appl. No.: 609,259

[52] U.S. Cl. ..... 58/50 R; 58/23 R; 58/55; 58/88 R

[51] Int. Cl.[2] ..... G04B 19/30; G04C 3/00; G04B 37/00

[58] Field of Search ..... 58/23 R, 50 R, 53–55, 58/88 R, 90 R, 91

[56] References Cited

UNITED STATES PATENTS

| | | | |
|---|---|---|---|
| 3,640,065 | 2/1970 | Lederrey et al. | 58/90 R |
| 3,838,568 | 10/1974 | Zurcher | 58/88 |
| 3,863,436 | 2/1975 | Schwarzchild | 174/52 R |

*Primary Examiner*—E. S. Jackmon
*Attorney, Agent, or Firm*—Allen A. Dicke; William H. MacAllister

[57] ABSTRACT

Electronic watch module comprises spacer block which has openings therein for batteries, crystal can, etc. and has locating pins thereon. The watch electronic substrate is located on the pins and carries most of the watch electronics including chips, printed circuitry and LED displays on the front. A cover is located on the pins, extends over many of the electronic components and resiliently engages in the watch case. The spacer block, substrate with its electronics and cover comprise the watch module which is resiliently mounted in the watch case by the resilient engagement.

6 Claims, 4 Drawing Figures

ELECTRONIC WATCH CONSTRUCTION

BACKGROUND OF THE INVENTION

This invention is directed to electronic watch module construction, and particularly the physical interrelationship of the parts of the watch module and the resilient engagement of the watch module in the watch case.

Since an electronic watch module is so different than the mechanism of motor driven escapement watches, the internal construction of the module and its mounting are quite different.

Resilient mounting is necessary in an electronic watch because the preferred material of the substrate is ceramic and ceramic is brittle. Ceramic is a stable, dielectric material, well suited to printed circuitry and the mounting of semiconductor chips and LED displays. However, with the batteries directly in engagement with the back of the substrate, if the watch is dropped in the wrong orientation the momentum forces of the battery cause cracking of the substrate and thus destruction of the watch. Energy absorbing mountings of the module overcome this problem.

SUMMARY OF THE INVENTION

In order to aid in the understanding of this invention it can be stated in essentially summary form that is directed to electronic watch construction wherein the watch module carries a protective cover over a portion of the electronics mounted on the substrate and the cover also resiliently engages the watch case to resiliently mount the module in the watch case.

It is thus an object of this invention to provide electronic watch construction wherein the module is resiliently mountable within the watch case.

It is another object to provide an electronic watch construction wherein a cover over some of the electronics also serves as the resilient mounting of the module in the watch case. It is a further object to provide a structure wherein the bottom spacer has locating pins thereon for locating the substrate and cover with respect to the bottom spacer.

It is a further object to provide an electronic watch construction wherein the spacer block is configured to receive and locate the various parts of the watch module for convenient and reliable assembly.

Other objects and advantages will become apparent from a study of the following portions of the specification, the claims and the attached drawings.

DESCRIPTION

Figure 1:
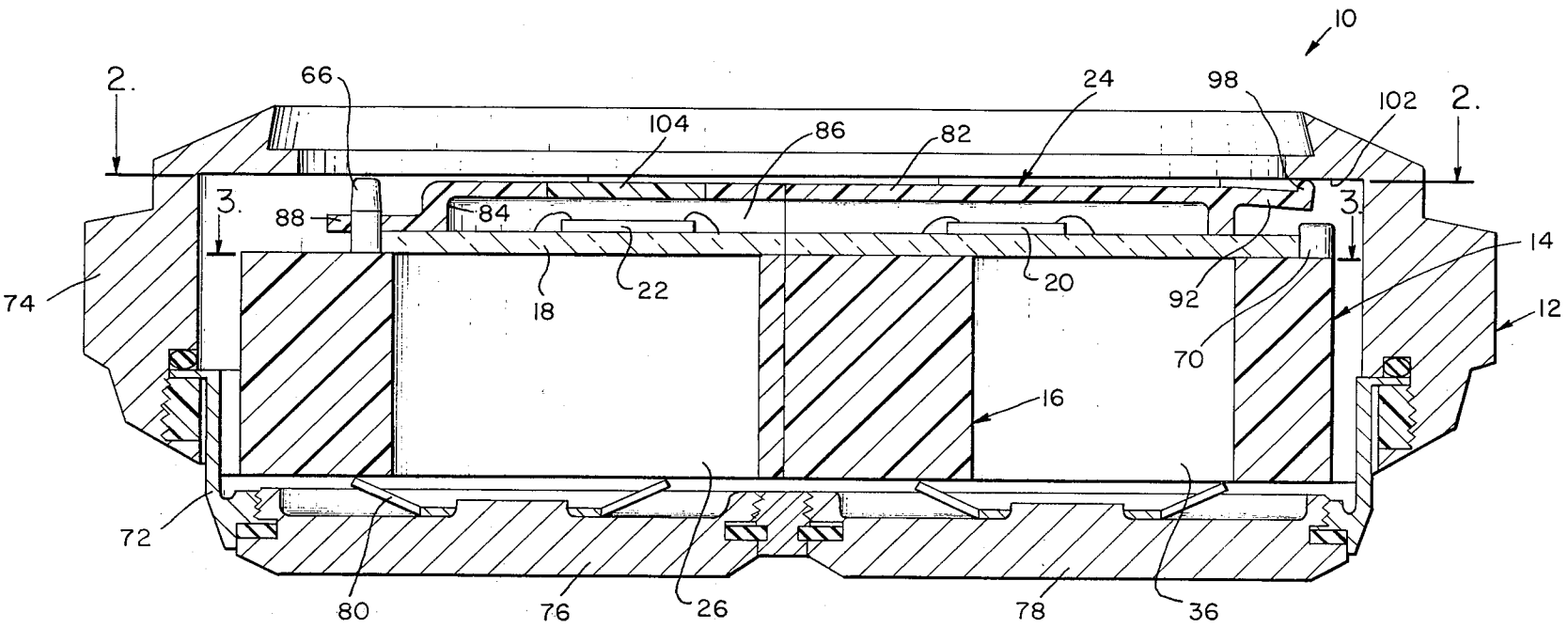
FIG. 1 is a section through a watch module of the electronic watch construction of this invention shown in association with a watch case, with the section taken generally along line 1—1 of FIG. 2.

FIG. 1 illustrates watch 10 employing the electronic watch module construction of this invention. Watch 10 comprises watch case 12 and watch module 14. Watch module 14 is comprised of bottom spacer block 16, substrate 18 carrying electronics including horological data processing chips 20 and LED displays 22 which are interconnected by printed circuitry and wire bonds. The module also carries cover 24 which overlies the chips and displays, protects the wire bonds and the major portion of the printed circuitry, has a window therein for viewing the displays from the front of the module and resiliently engages in the watch case as is hereinafter described.

Figure 3:
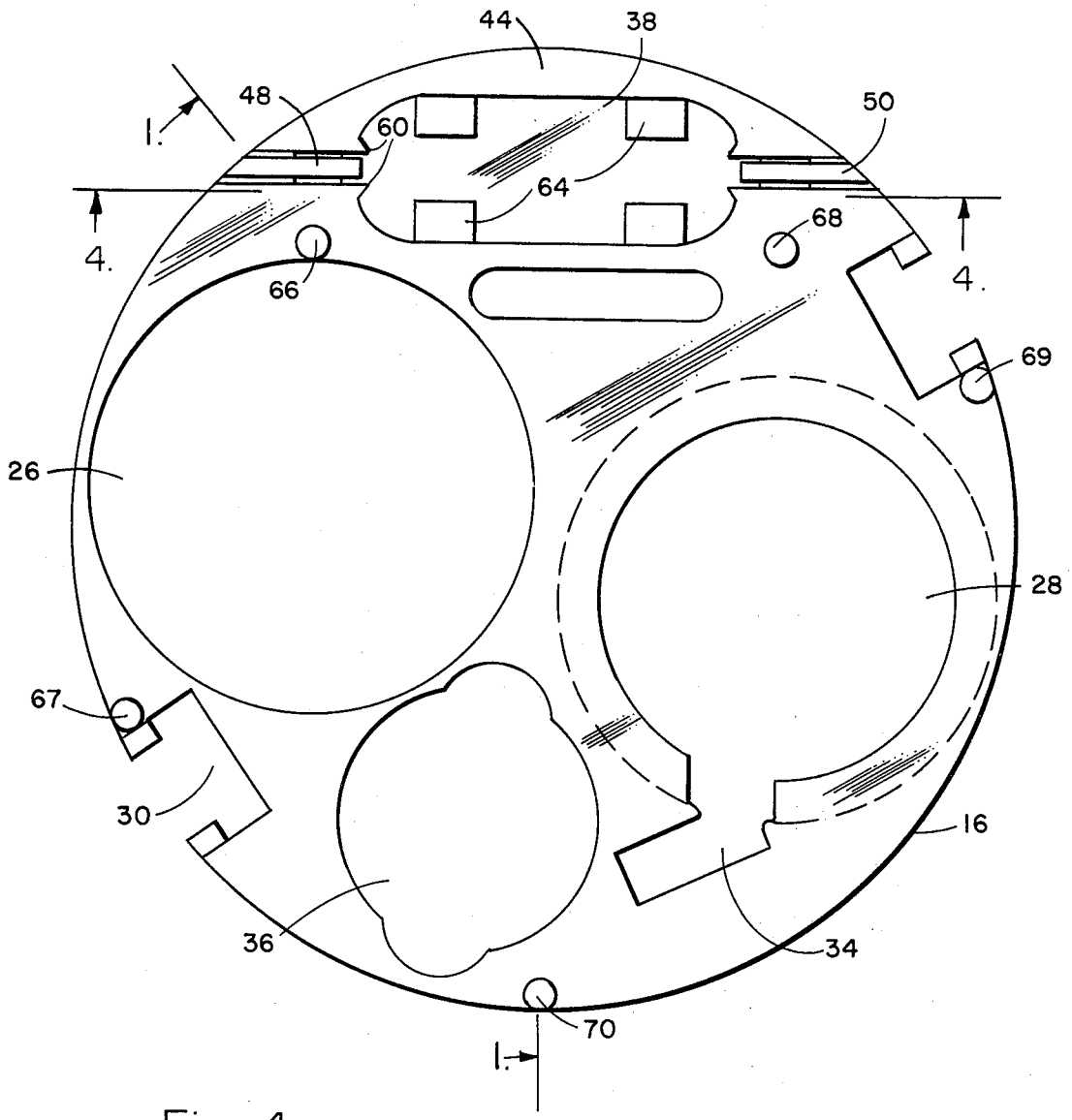
FIG. 3 is a top plan view of the spacer block of the watch module, as generally seen along the line 3—3 of FIG. 1.

As seen in FIG. 3, bottom spacer block 16 has battery openings 26 and 28, with battery opening 28 having a reduced diameter opening at its upper end so that a button type battery can be fully inserted only with its button extending in upward direction, to prevent reversed polarity of that battery. Openings 30 and 32 are for push button contact springs for input signalling into the watch electronics while spring opening 34 is for connection of the case potential of the battery in opening 28 to the electronics. These spring contacts are shown in more detail in Zurcher and Merles U.S. Pat. No. 3,838,568 and in Burke, Zurcher and Somogyi patent application Ser. No. 563,927, filed Mar. 31, 1975.

The bottom spacer block 16 also has an opening 36 therein to receive a trimmer capacitor for adjusting the watch frequency and has an opening 38 therein for receiving and retaining the crystal can.

Figure 4:
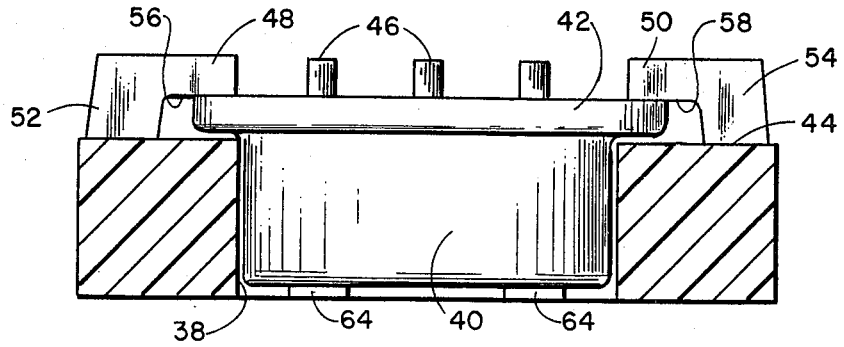
FIG. 4 is a section taken generally along line 4—4 of FIG. 3, showing the structure of the spacer block for receiving and retaining the crystal can, with the can in place.

As seen in FIG. 4, crystal can 40 has an outwardly extending flange 42. Contact pins 46 extend upward from the flanged side of the can. One of the contact pins is grounded while the other two are connected to opposite sides of the crystal. The contact pins are connected to appropriate circuits on the substrate by wire bonding, direct soldering, or by other connections such as shown in commonly assigned patent application Ser. No. 608,434 filed Aug. 28, 1975 by Rudolf F. Zurcher. Crystal can 40 is preferably retained in its opening 38 by resilient ears 48 and 50 as described in more detail in commonly assigned copending Zurcher patent application Ser. No. 609,258 for Electronic Watch Construction filed Sept. 2, 1975.

Ear supports 52 and 54 extend upward from the upper surface 44 and carry resilient ears 48 and 50 thereon. Resilient ears 48 and 50 each have a lower surface 56 and 58 facing surface 44 and spaced from surface 44 to engage over flange 42. The material of spacer block 16 is resilient synthetic polymer composition material, such as polycarbonate, and preferably the polycarbonate sold under the proprietary name of Lexan 141. The cross section of the resilient ears 48 and 50 is sufficiently small so that the ears can be resiliently bent back, the crystal can 40 pressed into its opening 38 and the ears thereupon resiliently returned over the flange of the cans to resiliently hold the can firmly in place. Tabs 64 are formed on the spacer at the bottom of opening 38 to space the can away from the watch case to prevent electrical contact therebetween. Thus can 40 is constrained between ears 48 and 50 and tabs 64.

Furthermore, ridges 60 and 62, see FIG. 3, are formed at the opposite ends of opening 38. The ridges extend part way into the opening and are of such dimension that the ridges are resiliently deformed by the walls of the can as the can is pressed into place. Thus, crystal can 40 is also laterally restrained.

Figure 2:
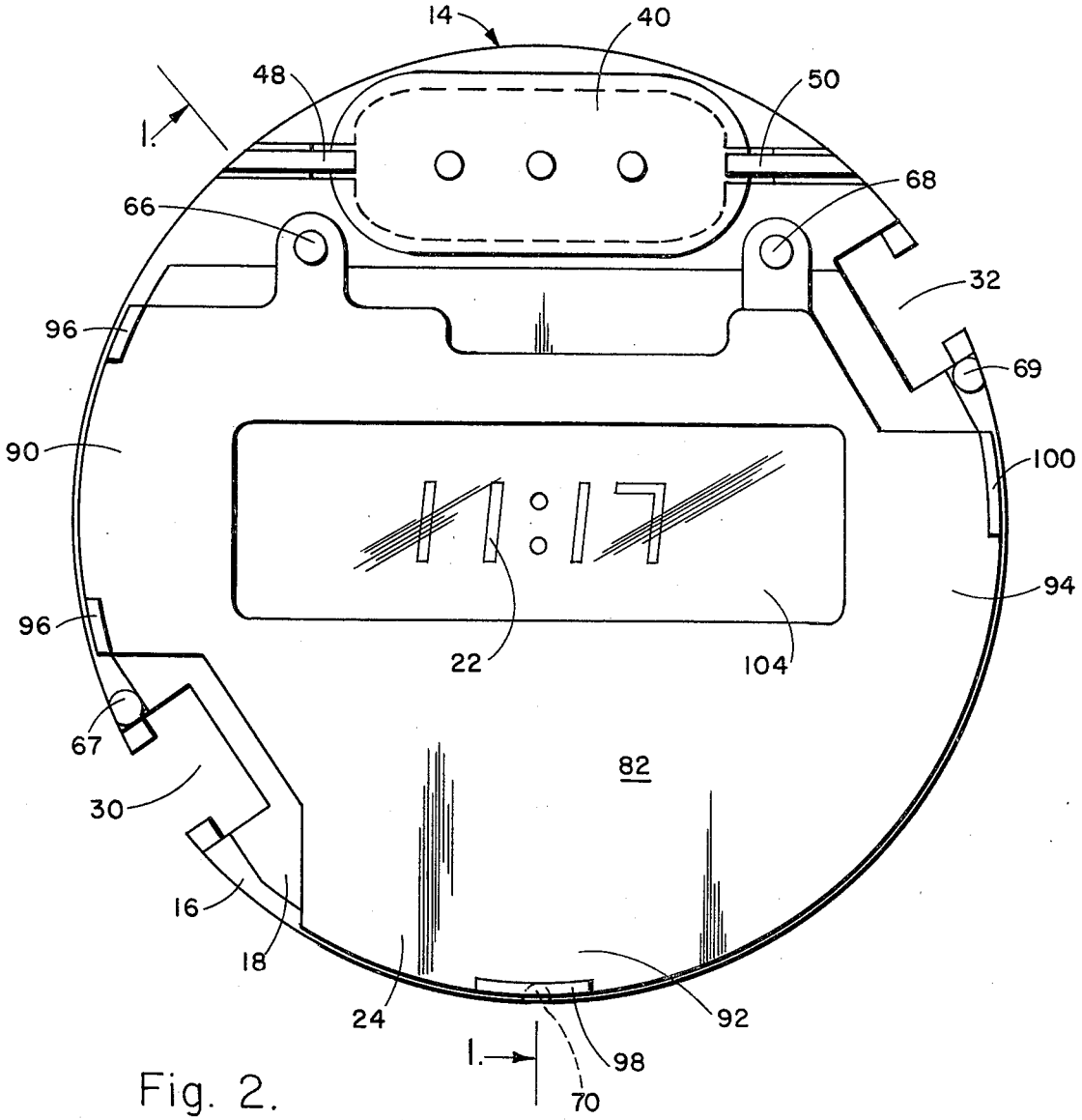
FIG. 2 is a top plan view of the watch module of this invention as generally seen along the line 2—2 of FIG. 1.

Locating pins 66, 67, 68, 69 and 70 are integrally formed on spacer block 16 and serve as locating points for the assembly of the watch module. As is seen in FIGS. 1 and 2 substrate 18 engages against the locating pins. In this way the structures on the substrate which cooperate with the spacer block, such as contact springs and openings therefore, as well as battery contact and battery openings are properly interrelated. Furthermore, the locating pins permit the substrate to be quickly and accurately assembled onto the bottom spacer with a minimum of time and skill required in the assembly.

Watch case 12 is of conventional construction, with removable back 72 which is clamped and sealed with respect to the body 74 of the case. Back 72 has hatch covers 76 and 78, which are actually in alignment with battery openings 26 and 28 to permit removal and replacement of the batteries. It is thus seen that the section through the watch case in FIG. 1 is somewhat different than the section through the module, in order to fully illustrate the details of each. Each of the hatch covers has a battery spring, such as battery spring 80 on hatch cover 76. The battery spring resiliently urges the battery upward into electrical contact with the battery contact on the bottom of the substrate 18 and makes electrical contact with the bottom of the battery. The two hatches are electrically connected together so that electric connection is made between the ends of the two batteries facing the hatch covers. In FIG. 1 it is seen that the only structure engaging with the watch module and urging it in the upward direction are the battery springs. Thus, when the downward shock of the module with respect to the case occurs, the battery springs resiliently pick up the shock loads.

As is seen in FIG. 1, cover 24 has face 82 which is spaced over the front of substrate 18 and over the chips and displays mounted thereon. It is spaced by continuous flange 84 which is downturned from the face to maintain the spacing of the face and to continuously engage the front of the substrate. Flange 84 is sealed to the substrate, as by epoxy in order to maintain the protected space 86 beneath the face within the confines of the flange as a protected space. The space can be filled with a protective gas, such as dry nitrogen, if desired. Cover 24 is preferably of dielectric synthetic polymer composition material so that it may be cemented down over the printed circuitry where it extends out of the protected space, without short circuiting the circuitry. Foot 88 lies against the face of the substrate and has openings therethrough for engagement over locating pin 66 and 68. This is enough location to properly locate the cover, but if structurally convenient the cover can also have a notch for location on pin 70. As it is seen in FIG. 4, webs 90, 92 and 94 extend outward from flange 84 at the level of face 82. The webs carry fingers 96, 98 and 100 at the outer edges thereof. These fingers engage under the downwardly facing stop surface 102, (see FIG. 1), to resiliently urge the cover and the entire module downward. Thus, shocks in that direction are resiliently absorbed by deflection of fingers 96, 98 and 100 to protect the module. Furthermore, the resilient deflection of the fingers urges the cover downward upon the substrate to retain it in place. Cover 24 has a clear window 104 so that the display 22 can be observed from the front of the watch. Preferably, the remainder of the cover is opaque to protect chip 20 and other electronic chips against light. Cover 24 is also preferably made of polycarbonate synthetic polymer composition material, of clear material in the area of window 104, with opaque paint away from the window area. The cover can alternatively be of clear red material to act as a contrast enhancing filter for the LED displays, together with paint around the window. Thus, the cover serves both for protection of the substrate against physical damage by direct damage or shock damage and serves to protect the chips against light. All references to related disclosures are incorporated herein in their entirety.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

I claim:

1. An electronic watch module for use in a watch case having a downwardly facing stop surface comprising:

a spacer block having an opening therein for the containment of a battery;

a substrate having a front and back and having its back positioned toward said spacer block for contact with a battery in the battery opening and having electronic components on the front of said substrate;

a cover positioned over at least part of said substrate for protection of at least part of the electronic components on the front of said substrate, a resilient web on said cover having a finger on said web for engagement with the stop surface in the watch case for positioning of said module within the watch case, said web being resilient so that said module is resiliently mounted in the watch case in a direction causing web deflection.

2. The electronic watch module of claim 1 wherein said cover is formed of resilient synthetic polymer composition material.

3. The electronic watch module of claim 2 wherein at least one of said electronic components on the front of said substrate is an optical display and said cover is transparent over said optical display for permitting viewing of said optical display.

4. The electronic watch module of claim 3 wherein at least two locating pins are positioned on said spacer block and extend upward from the top surface of said spacer block, said substrate engaging said locating pins to locate said substrate with respect to said spacer block and said cover engaging said locating pins to locate said cover with respect to said substrate and said spacer block.

5. The combination wherein said watch module of claim 1 is positioned within a watch case.

6. The combination of claim 5 wherein said watch case has a battery contact spring positioned adjacent said battery opening in said spacer block so that when a battery is placed in said battery opening the battery is resiliently urged toward said substrate and into contact with said substrate to resiliently urge said finger into engagement with the stop surface in said watch case.

* * * * *